United States Patent [19]

Andrew

[11] 3,950,853

[45] Apr. 20, 1976

[54] TRACK TYPE DRAFTING MACHINE

[76] Inventor: William H. Andrew, 382 Knollwood Drive, Highland Heights, Ky. 41076

[22] Filed: Feb. 12, 1975

[21] Appl. No.: 549,327

[52] U.S. Cl. ..... 33/79 R; 33/1 M
[51] Int. Cl.[2] ..... B43L 13/02
[58] Field of Search ..... 33/76 R, 79 R, 1 M

[56] References Cited

UNITED STATES PATENTS

| | | | |
|---|---|---|---|
| 534,865 | 2/1895 | Dolen | 33/80 |
| 2,618,860 | 11/1952 | Engelhart | 33/1 M |
| 2,621,411 | 12/1952 | Christen | 33/76 |
| 2,928,178 | 3/1960 | Wilcox | 33/79 R |
| 3,345,747 | 10/1967 | Sattler | 33/1 M |

FOREIGN PATENTS OR APPLICATIONS

| | | | |
|---|---|---|---|
| 771,607 | 4/1957 | United Kingdom | 33/1 M |
| 345,452 | 2/1921 | Germany | 33/76 |
| 82,798 | 4/1920 | Switzerland | 33/79 |
| 543,448 | 5/1956 | Italy | 33/79 |

*Primary Examiner*—Richard E. Aegerter
*Assistant Examiner*—John W. Shepperd
*Attorney, Agent, or Firm*—Melville, Strasser, Foster & Hoffman

[57] ABSTRACT

An accessory for a track type drafting machine mounted for motion over the surface of a drawing board. The drafting machine accessory includes a set of endless graduated tapes running between rollers mounted at the ends of horizontal and vertical tracks. A set of indicators move along the tapes. One of the indicators is mounted on the drafting machine head carriage and moves along the length of the vertical track, so as to move along the vertical tape. The other indicator is mounted on the vertical track carriage and is moveable along the horizontal tape. A set of right-angled, common origin scales is fitted to the drafting machine head. The graduated tapes are each provided with a zero point from which positive numbers progress in one direction and negative numbers progress in the other. Means are provided for rotating each tape about its respective rollers to adjust the position thereof. Finally, means are provided to lock the tapes in their adjusted positions.

3 Claims, 10 Drawing Figures

TRACK TYPE DRAFTING MACHINE

BACKGROUND OF THE INVENTION

1. Field of the Invention

The invention relates to drafting machines which are useful, in general, as a means of aiding in engineering drawing work, so as to quickly and accurately measure and draw straight lines between desired points, and more particularly, to improvements in track type drafting machines.

2. Description of the Prior Art

A draftsman/designer's productive time may generally be divided into two broad catagories; namely, creative or thinking time, and physical or drawing time. The present invention is concerned with reducing the physical or drawing time.

In using a typical track type drafting machine, once the drafting machine head is moved away from its particular point, there is no way of determining the relationship of a new point at a new location to the old point unless the draftsman marks the new point and measures the distance back to the old point with the individual scales and some construction lines. In the same manner, the only reasonably accurate method of laying out a second point in relation to a first point is by drawing a base line, measuring one dimension along it and marking a point thereon, then drawing a perpendicular line at this point and measuring the other dimension along the perpendicular line. For example, if a draftsman desired to lay out point B, 6 inches horizontally and 3 inches vertically from point A, the normal routine would be to draw a construction or base line through point A, measure and mark a point 6 inches from point A, draw a vertical construction line through this point and measure 3 inches up from the base line on the second or vertical construction line.

Additionally, it should be noted that when using a standard track type drafting machine, there is no dimensional relationship between the right angled scales fitted to the drafting machine head. The only way to use the horizontal scale for anything other than a straight edge is to move the zero point on the scale to some reference line or point. The same applies to the vertical scale.

It will thus be apparent that the prior art has long endeavored to develop improvements in a track type drafting machine whereby the exact location of any other point on a drawing board to which the scales are moved is immediately known in relation to a starting point. In this regard, the prior art has developed a coordinate measuring machine which utilizes optical scales and is highly accurate. However, while this machine has definite advantages, its primary disadvantages include expense of manufacture and the necessary modifications to a drafting machine and drawing board before the machine can be incorporated therewith. Additionally, the coordinate measuring machine is designed more for measuring than laying out dimensions and the cost prohibits it being marketed as a general drafting aid.

While endless tapes (see, for example, U.S. Pat. No. 3,193,195, in the name of C. S. Jeffries, Jr., and U.S. Pat. No. 2,549,634, in the name of L. V. Parsons) and common origin scales (see U.S. Pat. No. 2,551,082, in the name of H. Anderegg) are known, the prior art has never combined the teachings in such a way to develop an improved track type drafting machine wherein the exact location of any other point on a drawing board to which right-angled rules fitted to the drawing machine head are moved in relation to the starting point is immediately known.

SUMMARY OF THE INVENTION

A typical track type drafting machine includes a horizontal track mounted on the top of the drawing board, a vertical track running from the top to the bottom of the drawing board perpendicular to the horizontal track in a carriage which rolls in the horizontal track for movement along the length of the horizontal track, the carriage carrying the vertical track and maintaining the vertical track at all times perpendicular to the horizontal track. A drafting machine head is mounted on its carriage and is moveable along the length of the vertical track. Right-angled rules are fitted to the head for laying dimensions, measuring and as straight edges for drawing lines.

The present invention provides improvements in a track type drafting machine. In this regard, a first endless graduated tape is provided running about rollers mounted at the ends of the horizontal track. A second endless graduated tape is also provided running about rollers mounted at the ends of the vertical track. Both of the tapes have a zero point from which positive numbers progress in one direction and negative numbers progress in the other.

A first hairline indicator is mounted on the vertical track carriage and extends transversely of the first tape for movement along the first tape as the vertical track carriage is moved along the horizontal track. A second hairline indicator is mounted on the drafting machine head carriage and extends transversely of the second tape for movement along the second tape as the drafting machine head carriage is moved along the length of the vertical track. Means are provided for rotating the first and second endless tapes about their respective pulleys to adjust the position thereof and to lock the tapes in their adjusted position. Finally, the right-angled rules fitted to the head comprise a set of common origin scales.

In operation, any movement of the drafting machine head, horizontally or vertically, is indicated on the first and second tapes, respectively, and when the origin of the common origin scales is at a starting point and the first and second tapes are adjusted so that the zero point on each tape is located under that tapes respective hairline indicator and the first and second tapes are locked, the exact location of any other point on the drawing board to which the common origin scales or drafting machine head are moved in relation to the starting point is immediately known.

BRIEF DESCRIPTION OF THE DRAWINGS

FIG. 10 is an enlarged fragmentary perspective view of the common origin scales.

DESCRIPTION OF THE PREFERRED EMBODIMENTS

Figures 1, 2, 3:
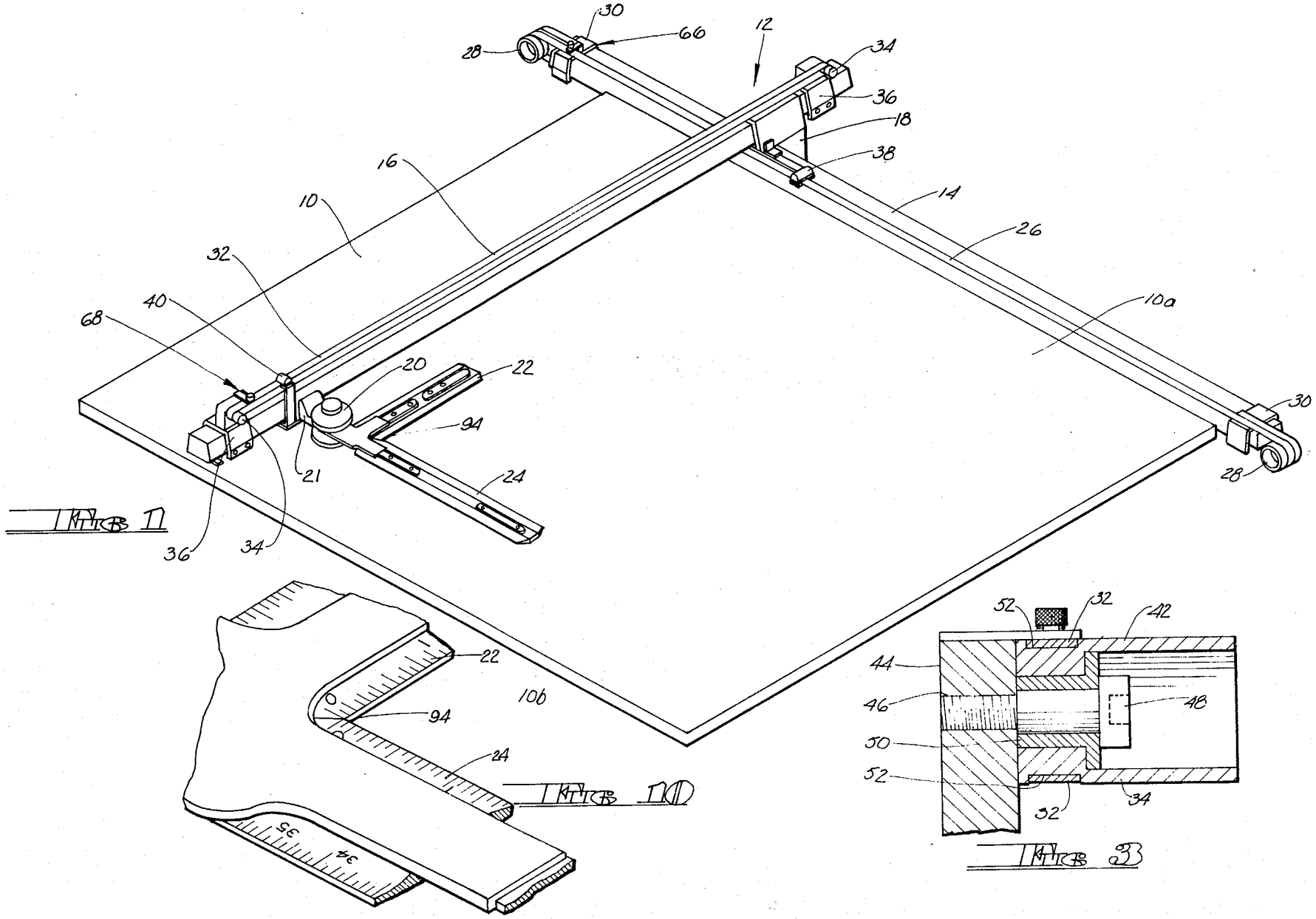
FIG. 1 is a perspective view of a drafting board incorporating the improved track type drafting machine of the present invention.
FIG. 2 is an enlarged perspective view of the adjustment and lock for the Y-axis as well as the Y-axis hairline indicator.
FIG. 3 is a cross sectional view taken along the line 3—3 of FIG. 2.
Figures 2, 4, 5:
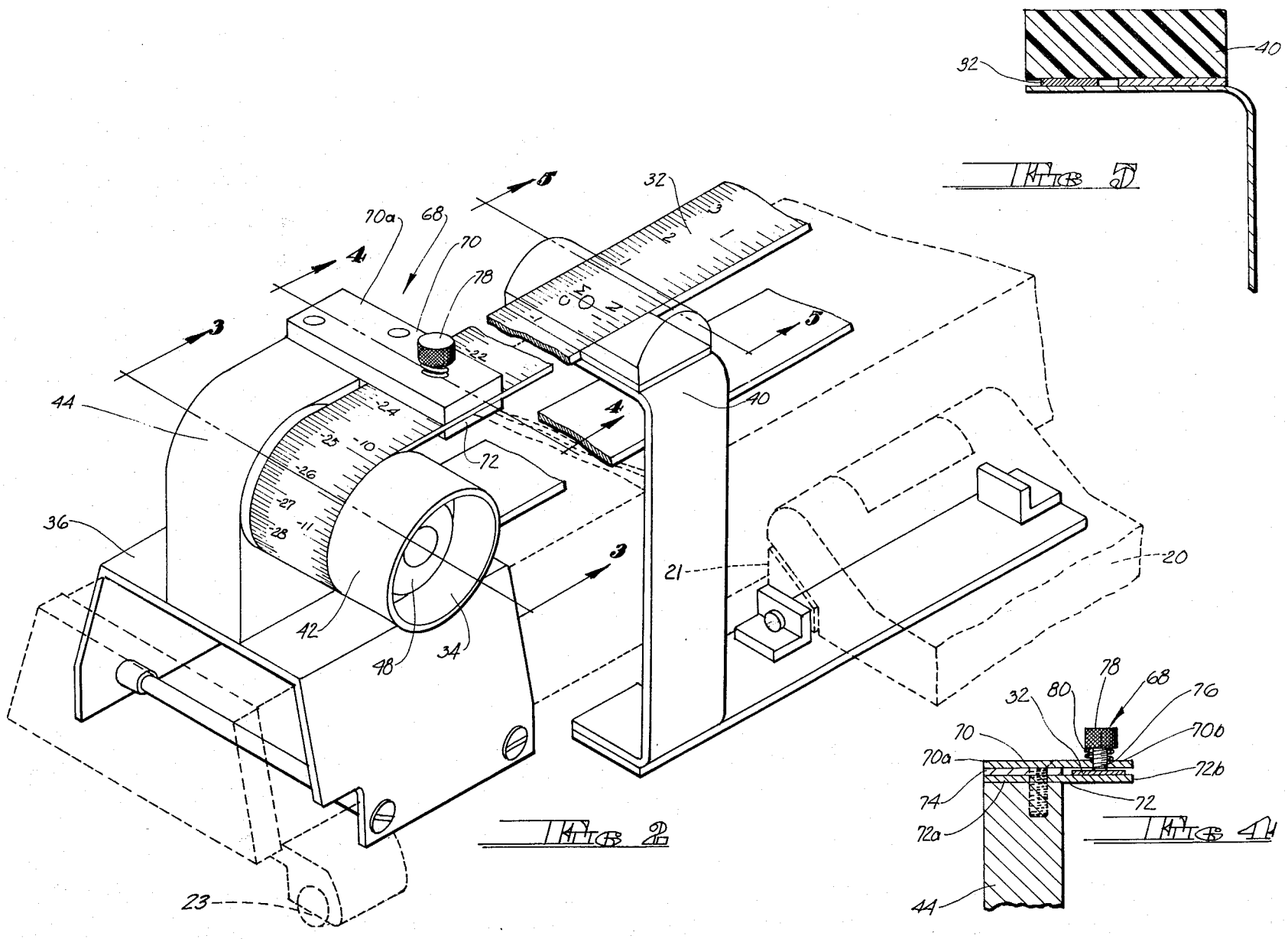
FIG. 4 is a cross sectional view taken on the line 4—4 of FIG. 2.
FIG. 5 is a cross sectional view taken on the line 5—5 of FIG. 2.

Referring more particularly to FIG. 1, the drawing board 10 is mounted on a suitable support (not shown) and is adapted to be inclined in any position from horizontal to vertical. The board 10 may be made of any suitable material, including steel, wood, plastics and glass.

A conventional-like track type drafting machine 12 is mounted in association with the drawing board 10. As can be seen, the track type drafting machine 12 includes a horizontal track 14 mounted on the top 10*a* of the drawing board 10 and a vertical track 16 running from the top 10*a* to the bottom 10*b* of the drawing board 10 perpendicular to the horizontal track 14. A first carriage 18 is attached to the top 10*a* of the drawing board 10 by brackets (not shown) which screw or clamp to the top 10*a* of the board 10 for movement along the length of the horizontal track 14. The carriage 18 carries the vertical track 16 and maintains the vertical track 16 at all times perpendicular to the horizontal track 14. The vertical track 16 is supported at the top end by the first carriage 18 and on the bottom end by the roller 23. A drafting machine head 20, which is rotatable about its axis and carries a set of rules 22 and 24 set at right angles in the usual manner, is mounted on a second carriage 21, which is moveable along the length of the vertical track 16. The right-angled rules 22 and 24 fitted into the drafting machine head 20 provide for laying dimensions, measuring and as straight edges for drawing lines.

According to the present invention, a first endless graduated tape 26 is provided running about rollers 28 mounted at the ends of the horizontal track 14. In practice bracket means 30 are provided at the ends of the horizontal track 14 to support the rollers.

A second endless graduated tape 32 is provided running between rollers 34 mounted at the ends of the vertical track 16. Again, in practice bracket means 36 are provided at the ends of the vertical track 16, with each one of the bracket means 36 supporting one of the rollers 34.

The first and second tapes 26 and 32, respectively, are each provided with a zero point from which positive numbers progress in one direction and negative numbers progress in the other, as best seen, for example, in FIG. 2.

A first hairline indicator 38 is mounted on the first carriage 18. The indicator 38 extends transversely of the first tape 26 for movement along the first tape 26 as the carriage 18 is moved along the horizontal track 14. The indicator 38 may include a magnifying type convex glass which magnifies the indicia on the tape 26. In like manner, a second hairline indicator 40 is mounted on the second or head carriage 21. As can be seen, the indicator 40 extends transversely of the second tape 32 for movement along the second tape as the head carriage 21, and thus the head 20, is moved along the length of the vertical track 16. The indicator 40 may also be provided with a magnifying type convex glass to magnify the indicia on the tape 32.

Means are provided for rotating each of the tapes 26 and 32 about their respective rollers 28 and 34. As best seen in FIGS. 2 and 3, the means for rotating the tape 32 comprises at least one of the rollers 34 which has been provided with an extension 42. As previously indicated, the roller 34 is supported by a shoulder 44 of the mounting bracket 36. As can be seen, the shoulder 44 is provided with a threaded aperture 46 which receives a screw 48, which passes through a bushing 50 in the roller 34. The peripheries of the rollers 34 are preferably provided with a recessed track portion 52 which receives the tape 32 in frictional engagement. If desired, the extension 42 of the rollers 34 may be knurled on its periphery for easier manual turning.

Figure 8:
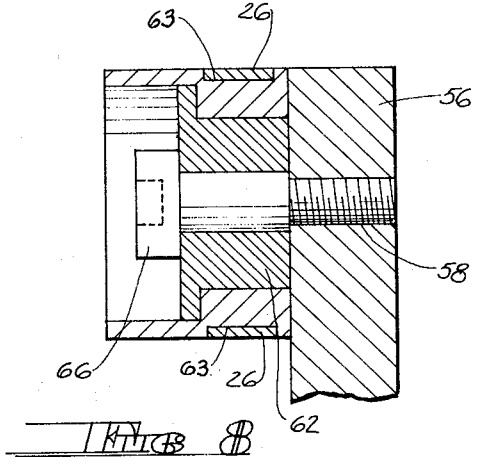
FIG. 8 is a cross sectional view taken on the lines 8—8 of FIG. 6.
Figure 6:
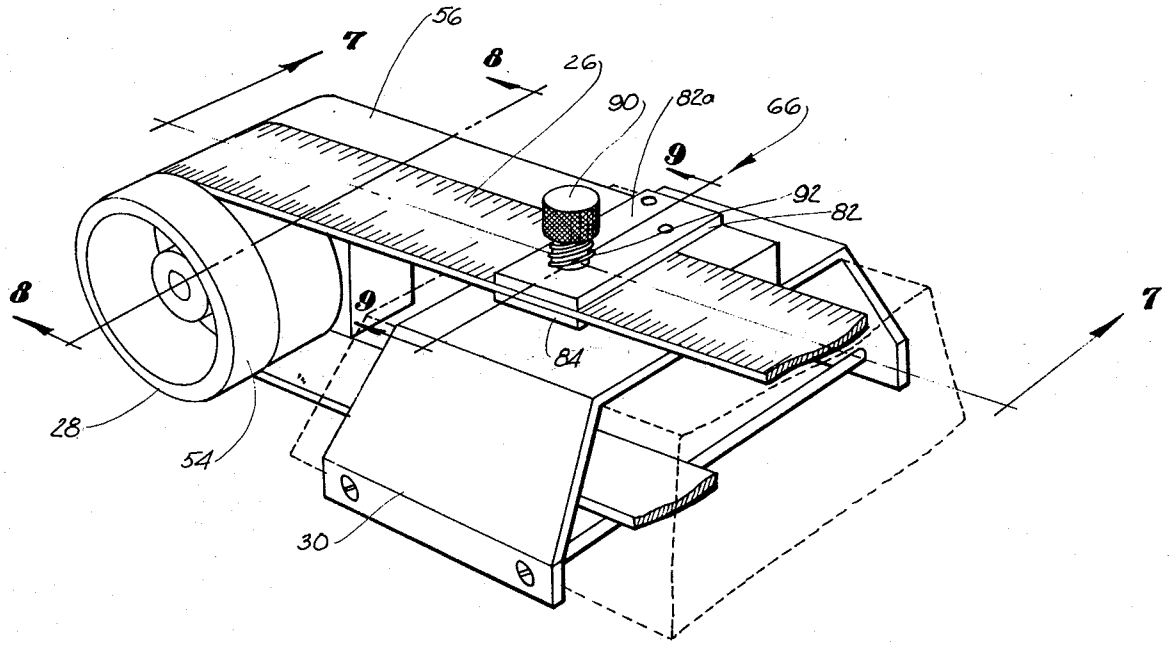
FIG. 6 is an enlarged perspective view of the adjustment and lock for the X-axis.
Figure 7:
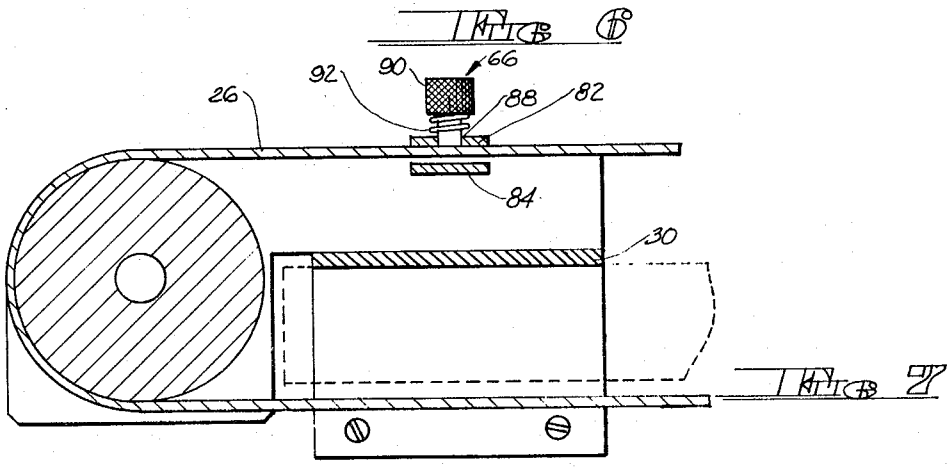
FIG. 7 is a cross sectional view taken on the lines 7—7 of FIG. 6.

Similarly, and as best seen in FIGS. 6, 7 and 8, the means for rotating the tape 26 comprises at least one of the rollers 28, which has been provided with an extension 54. As previously indicated, each roller 28 is supported by a shoulder 56 of the mounting bracket 30. As can be seen, the shoulder 56 is provided with a threaded aperture 58 which receives a screw 60 which passes through a bushing 62 in the roller 28. The peripheries of the rollers 28 are preferably provided with a recessed track portion 63 which receives the tape 26 in frictional engagement. If desired, the extension 54 of the rollers 28 may be knurled on their peripheries for easier manual turning.

Each of the tapes 26 and 32 is provided with means to lock the tape in its adjusted position. Briefly, the means to lock the first tape 26 and the means to lock the second tape 32 each comprise clamping means 66 and 68 mounted on the first and second tracks 26 and 32, respectively. As best seen in FIGS. 1, 2, 3 and 4, the clamping means 68 comprises elements 70 and 72, the fixed ends 70*a* and 72*a* of which are separated by the spacer 74 and the free ends 70*b* and 72*b* of which provide an opening through which the tape 32 may freely pass. The upper most one of the elements 70 is provided with a threaded hole 76 for receiving a set screw 78. The head of the set screw is preferably knurled for easy grasping and the end of the screw is flat. A spring 80 may be utilized to provide drag for the screw 78. In operation, the tape 32 may be adjusted as desired by rotating one of the extensions 42 of the rollers 34, until the desired indicia on the tape 32 appears under the hairline indicator 40, at which time the position of the tape 32 may be locked by turning the set screw 78 so that is presses against the tape 32 and holds the tape 32 snuggly against the lower element 72.

Figure 9:
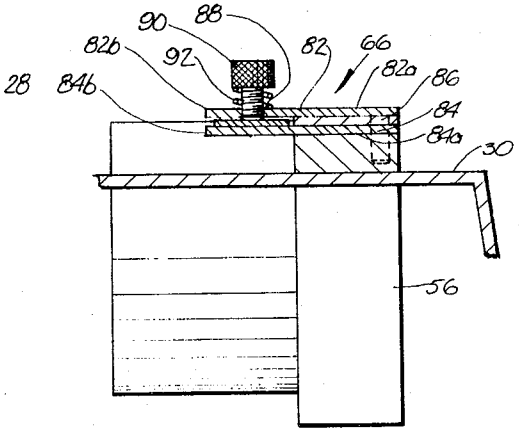
FIG. 9 is a cross sectional view taken on the line 9—9 of FIG. 6.

In similar manner, and as best seen in FIGS. 6, 7 and 9, the clamping means 66 comprises elements 82 and 84, the fixed ends 82*a* and 84*a* of which are separated by the spacer 86 and the free ends 82*b* and 84*b* of which provide an opening through which the tape 26 may freely pass. The upper most element 82 is provided with a threaded hole 88 for receiving a set screw 90. The head of the set screw 90 is preferably knurled for easy grasping and the end of the screw is flat. A spring 92 may be utilized to provide drag for the screw 90. In operation, the tape 26 may be adjusted as desired by rotating the extensions 54 of the rollers 28 until the desired indicia on the tape 26 appears under the hairline indicator 38, at which time the position of the tape 26 may be locked by turning the set screw 90 so that it presses against the tape 26 and holds the tape snuggly against the lower element 84.

According to the present invention, and as best seen in FIG. 10, the right angled rules 22 and 24 comprise a set of common origin scales 22 and 24 which allow for the horizontal and vertical scales of the rules to meet at a common origin 94 and also provide service as a right angle. The rules 22 and 24 may be separate rules or they may comprise a unitary, integral, one piece L-shaped scale.

In operation, any movement of the drafting machine head 20, horizontally or vertically, is indicated on the first and second tapes 26 and 32, respectively, and when the origin 94 of the common origin scales 22 and 24 is at a starting point and the first and second tapes 26 and 32 are adjusted so that the zero point on each tape is located under that tapes respective hairline indicator 38 and 40 and the first and second tapes are locked by the clamping means 66 and 68, the exact location of any other point on the drawing board 10 to which the origin 94 of the common origin scales 22 and 24 or the drafting machine head 20 are moved in relation to the starting point is immediately known.

The common origin 94 serves the additional more important purpose of providing a right angle with common origin at all times. Since so many right angles are drawn, this becomes particularly important in mechanical drafting. With the standard scale arrangement, it is always necessary to move the horizontal scale to add the horizontal leg of a right angle. Also, in order to lay out a horizontal dimension, it is always necessary to move the horizontal zero to a reference line or point, usually a vertical line. None of these additional moves is necessary with a track type drafting machine incorporating the improvements of the present invention, since both legs may be drawn in one movement without moving the head 20 and any horizontal dimension is immidiately available from the vertical scales since the scales have a common origin and are perpendicular. By analyzing each separate movement that would be required with a standard machine, and listing the individual steps, the time savings when using the improved drafting machine of the present invention is quickly realized.

In summary, the improved track type drafting machine of the present invention eliminates repetitious returns to vertical and horizontal base lines or zero lines, plus or minus point layout requiring zeroing on each base line and working "backwards", "stacked" dimensions where the normal scale is not long enough, continual reference back to a previous location, and continuous checks when converting from English to Metric units or dual dimensioning by providing dual graduations on the tapes. Additionally, the addition of common origin scales 22 and 24 on the drafting machine head 20 allow the horizontal and vertical scales to be "squared" and still maintain a common origin 94 or zero point. This eliminates all of the drafting steps used when referring back to individual zero lines and having to use a random point on one scale as the reference point in conjunction with the adjustable tapes. Accordingly, it will thus be apparent that the improved track type drafting machine of the present invention is most applicable to several styles of mechanical drawings; namely, numerical controls, computer printouts, large castings, lofting and the like.

While a preferred embodiment of the invention has been illustrated, it will be understood that this is by way of illustration only, and that various changes and modifications may be made within the contemplation of the invention and within the scope of the claims. For example, the tapes 26 and 32 may have any desired engagement with the rollers 28 and 34, respectively, such as by sprockets and the like. However, for purposes of an exemplary showing, the rollers 28 and 34 have been shown in frictional engagement with the tapes 26 and 32, respectively.

I claim:

1. The combination of a drafting board and track type drafting machine mounted for motion over the surface of the drawing board comprising:

a. a horizontal track mounted on the top of said drawing board;

b. a vertical track running from the top to the bottom of said drawing board perpendicular to said horizontal track;

c. a first carriage attached to the top of said board which rolls in said horizontal track for movement along the length of said horizontal track, said first carriage carrying said vertical track and maintaining said vertical track at all time perpendicular to said horizontal track;

d. a second carriage movable along the length of said vertical track;

e. a drafting machine head mounted on said second carriage movable along the length of said vertical track;

f. right-angled rules fitted to said head for laying dimensions, measuring and as straight edges for drawing lines, said right-angled rules comprising a unitary, integral, one piece L-shaped scale with abutting rules of common origin;

g. a first endless graduated tape and rollers mounted at the ends of said horizontal track, said first tape running about said rollers and having a zero point from which positive numbers progress in one direction and negative numbers progress in the others;

h. a second endless graduated tape and rollers mounted at the ends of said vertical track, said second tape running about said rollers and having a zero point from which positive numbers progress in one direction and negative numbers progress in the other;

i. a first hairline indicator mounted on said first carriage and extending transversely of said first tape for movement along said first tape as said first carriage is moved along said horizontal track;

j. a second hairline indicator mounted on said second carriage and extending transversely of said second tape for movement along said second tape as said second carriage, and thus said head, is moved along the length of said vertical track;

k. means for rotating said first endless tape about its respective rollers to adjust the position thereof comprising at least one of said respective rollers of said first tape, said at least one roller having an extension by which it may be manually turned;

l. means to lock said first tape in an adjusted position comprising clamping means mounted on said horizontal track, said clamping means comprising spaced elements extending transversely of said first tape and through which said first tape freely passes, the uppermost one of said elements being provided with a threaded hole, and a set screw adjustably received within said hole for locking said tape in position;

m. means for rotating said second endless tape about its respective rollers to adjust the position thereof comprising at least one of said respective rollers of said second tape, said at least one roller having an extension by which it may be manually turned; and n. means to lock said second tape in an adjusted position comprising clamping means mounted on said vertical track, said clamping means comprising spaced elements extending transversely of said second tape and through which said second tape freely passes, the uppermost one of said elements being provided with a threaded hole, and a set screw adjustably received within said hole for locking said second tape in position;

whereby any movement of said machine head, horizontally or vertically, is indicated on said first and second tapes, respectively, and when the origin of said common origin scale is at a starting point and said first and second tapes are adjusted so that the zero point on each said tape is located under that tapes respective hairline indicator and said first and second tapes are locked, the exact location of another point on said drawing board to which said common origin scales or said drafting machine head are moved in relation to the starting point is immediately known.

2. The drafting machine according to claim 1, including bracket means at the ends of said horizontal track, each of said bracket means supporting one of said rollers, said clamping means for locking said first tape being mounted on one of said brackets.

3. The drafting machine according to claim 1, including bracket means at the ends of said vertical track, each of said bracket means supporting one of said rollers, said clamping means for locking said second track being mounted on one of said brackets.

* * * * *